US009375034B2

(12) United States Patent
Alima

(10) Patent No.: US 9,375,034 B2
(45) Date of Patent: Jun. 28, 2016

(54) COMBINATION ELECTRIC LIGHTER AND PORTABLE VAPORIZATION DEVICE

(71) Applicant: Yariv Alima, Plantation, FL (US)

(72) Inventor: Yariv Alima, Plantation, FL (US)

(73) Assignee: Atmos Nation LLC, Davie, FL (US)

( * ) Notice: Subject to any disclaimer, the term of this patent is extended or adjusted under 35 U.S.C. 154(b) by 516 days.

(21) Appl. No.: 13/973,764

(22) Filed: Aug. 22, 2013

(65) Prior Publication Data

US 2014/0217085 A1 Aug. 7, 2014

Related U.S. Application Data

(60) Provisional application No. 61/760,752, filed on Feb. 5, 2013.

(51) Int. Cl.

| | |
|---|---|
| ***H05B 3/02*** | (2006.01) |
| ***A24B 15/22*** | (2006.01) |
| ***F22B 1/02*** | (2006.01) |
| ***F22B 1/10*** | (2006.01) |
| ***A01G 13/06*** | (2006.01) |
| ***A01M 13/00*** | (2006.01) |
| ***A01M 19/00*** | (2006.01) |
| ***A61B 16/00*** | (2006.01) |
| ***A61L 9/03*** | (2006.01) |
| ***B01B 1/00*** | (2006.01) |
| ***F02M 15/04*** | (2006.01) |
| ***F02M 31/12*** | (2006.01) |
| ***F22B 1/20*** | (2006.01) |
| ***A24F 47/00*** | (2006.01) |
| ***F23Q 7/16*** | (2006.01) |

(52) U.S. Cl.

CPC ..... *A24F 47/008* (2013.01); *F23Q 7/16* (2013.01)

(58) Field of Classification Search

CPC .... A24F 47/002; A24F 47/008; A61M 15/00; A61M 15/0001; A61M 15/0023; A61M 15/06; F23Q 2/28

USPC ..... 219/260, 267–270, 472, 474, 535; 392/342, 386–387, 391, 394, 398; 131/290–312

See application file for complete search history.

(56) References Cited

U.S. PATENT DOCUMENTS

| | | | | | |
|---|---|---|---|---|---|
| 5,564,442 | A * | 10/1996 | MacDonald | A24F 47/008 | 131/194 |
| 5,880,439 | A * | 3/1999 | Deevi | B32B 18/00 | 219/535 |
| 5,954,979 | A * | 9/1999 | Counts | A24F 47/008 | 131/194 |
| 5,988,176 | A * | 11/1999 | Baggett, Jr. | A24F 47/008 | 131/352 |
| 6,349,728 | B1 * | 2/2002 | Pham | A24F 13/18 | 131/175 |

(Continued)

*Primary Examiner* — Dana Ross
*Assistant Examiner* — Lindsey C Teaters

(57) ABSTRACT

A combination electric lighter and portable vaporization device that functions as a dual purpose apparatus permitting a user to carry a portable vaporization apparatus that additionally functions as an electric lighter. The apparatus includes an integrated electrical source and a versatile heating element. The apparatus allows the user to ignite a plurality of smoking products but provides the option of vaporize the smoking products through the use of a vaporization device. The vaporization device can heat vaporizable material against the versatile electrically powered heating element in a manner that prevents ignition. The versatile heating element can function as a lighter, without requiring extensive configuration to light a smoking product. The apparatus is rechargeable. The component arrangement of the apparatus allows it to function as a portable electrical ignition device that can be utilized as a general purpose ignition device.

10 Claims, 10 Drawing Sheets

(56) References Cited

U.S. PATENT DOCUMENTS 6,536,442 B2 * 3/2003 St. Charles ..... A24F 47/004 131/185
2009/0302019 A1 * 12/2009 Selenski ..... A24F 47/008 219/201
2012/0097660 A1 * 4/2012 Bao ..... A61M 11/041 219/209
2012/0255546 A1 * 10/2012 Goetz ..... A61M 11/041 128/202.21
2012/0325229 A1 * 12/2012 Chang ..... F23D 91/02 131/329
2013/0152922 A1 * 6/2013 Benassayag ..... A61M 15/06 128/202.21
2013/0333709 A1 * 12/2013 Shimizu ..... A24F 7/02 131/223
2015/0136124 A1 * 5/2015 Aronie ..... A24F 47/008 128/202.21

* cited by examiner

COMBINATION ELECTRIC LIGHTER AND PORTABLE VAPORIZATION DEVICE

The current application claims a priority to the U.S. Provisional Patent application Ser. No. 61/760,752 filed on Feb. 5, 2013.

FIELD OF THE INVENTION

The present invention relates generally to a smoking accessory, more specifically, to a combination electric lighter and portable vaporization device.

BACKGROUND OF THE INVENTION

It is well known in the art that electric lighters are able to effectively ignite a plurality of smoking products without the use of volatile liquids or gasses. Electric lighters function by providing a component arrangement that allows an electrical current to safely interact with a heating element, producing sufficient heat to ignite a plurality of smoking products. While many variations exist, electric lighters typically comprise a heating element and an electrical source in order to classify as an electrical lighter. Although a plurality of electric lighter configurations exist, most electric lighters commonly suffer from major disadvantages that hinder their portability or limits their functionality as an ignition device.

One of the disadvantages observed in common electrical lighters is their reliance on an external electrical source. This disadvantage is best exemplified by the common vehicle cigarette lighter, which requires a complimentary cigarette lighter receptacle in order to connect to the electrical source. The complimentary cigarette lighter receptacle is an integrated component located within most vehicles. It utilizes a vehicles electrical system as the electrical source for the vehicle cigarette lighter. Without the complementary receptacle, the common vehicle lighter is unable to function. Although various alternative electric lighter configurations exist where the electric lighter is provided with an integrated electrical source, a large majority of these configurations limit the functionality of the electric lighter as an ignition device.

Generally electric lighters with integrated electrical sources are commonly found incorporated into portable electronic smoking devices. These portable electronic smoking devices utilize a modified heating element in order to heat specialized cartridges containing a vaporizable product. This particular arrangement limits the electric lighter from functioning as a portable ignition/heating device for a plurality of smoking products. This limitation in functionality is due to the specificity of the modified heating element. The modified heating element is designed to interact with a particular cartridge configuration. Furthermore, the modified heating element is designed to reach a specific temperature that is optimally suited for vaporizing the liquid solution contained within each particular cartridge configuration. This particular arrangement requires the heating element to be shaped and designed with specific tolerances that greatly limit its functionality as a general purpose ignition/heating device.

It is therefore the object of the present invention to provide a combination electric lighter and portable vaporization device that functions as a dual purpose apparatus permitting a user to carry a portable vaporization apparatus that additionally functions as an electric lighter. The apparatus includes an integrated electrical source and a versatile heating element. The apparatus allows the user to ignite a plurality of smoking products but provides the option of vaporize the smoking products through the use of a vaporization device. The vaporization device can heat vaporizable material against the versatile electrically powered heating element in a manner that prevents ignition. The versatile heating element can function as a lighter, without requiring extensive configuration to light a smoking product. The apparatus is rechargeable. The component arrangement of the present invention allows it to function as a portable electrical ignition device that can be utilized as a general purpose ignition device. Additionally the present invention is provided with an integrated electrical smoking device that is housed within the electrical lighter and utilizes the general purpose heating element to vaporize a plurality of smoking products.

BRIEF DESCRIPTIONS OF THE DRAWINGS

DETAIL DESCRIPTIONS OF THE INVENTION

Figure 1:
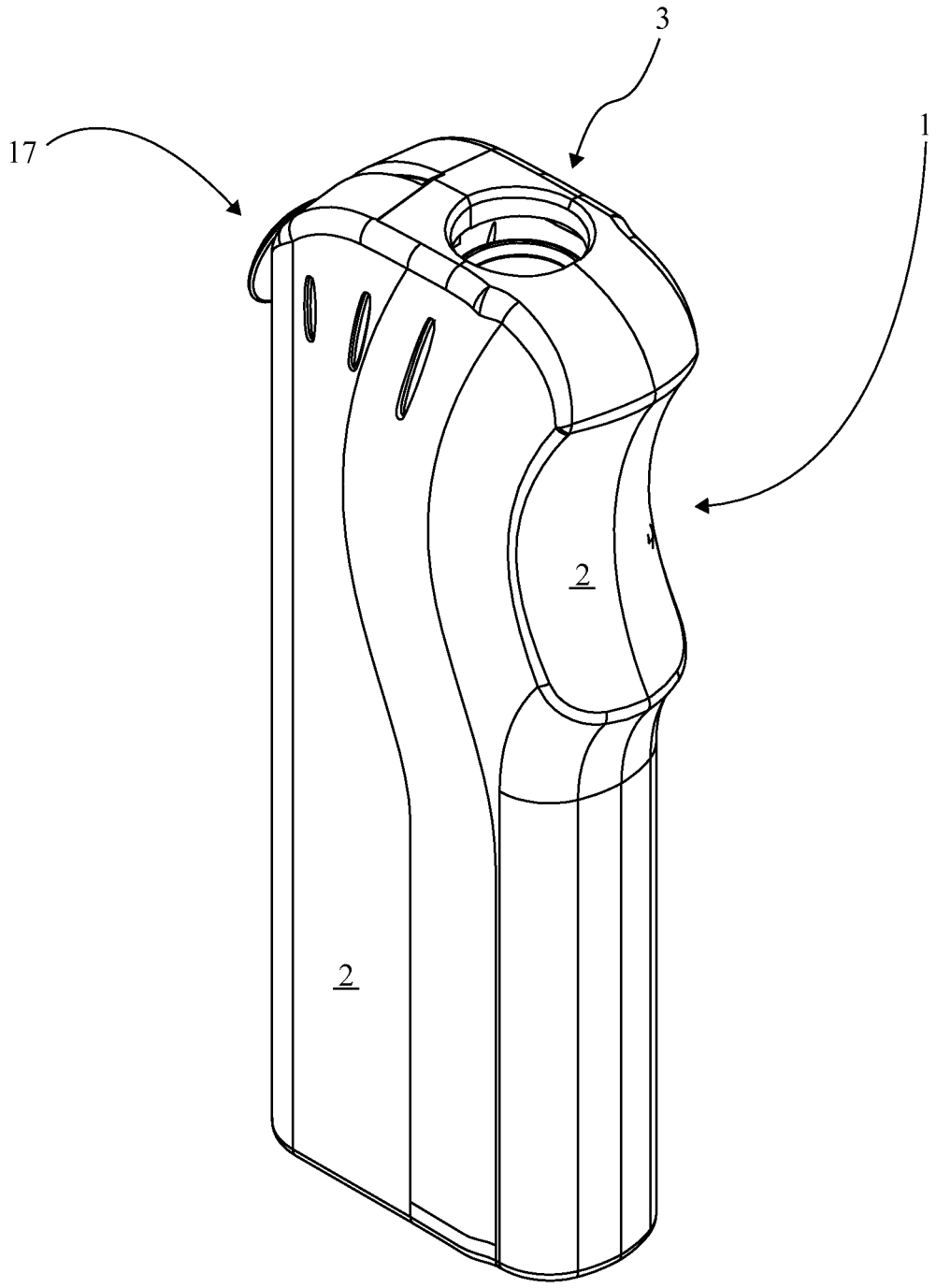
FIG. 1 is a perspective view displaying the combination electric lighter and portable vaporization device configured to function as a lighter as per the current embodiment of the present invention.
Figure 2:
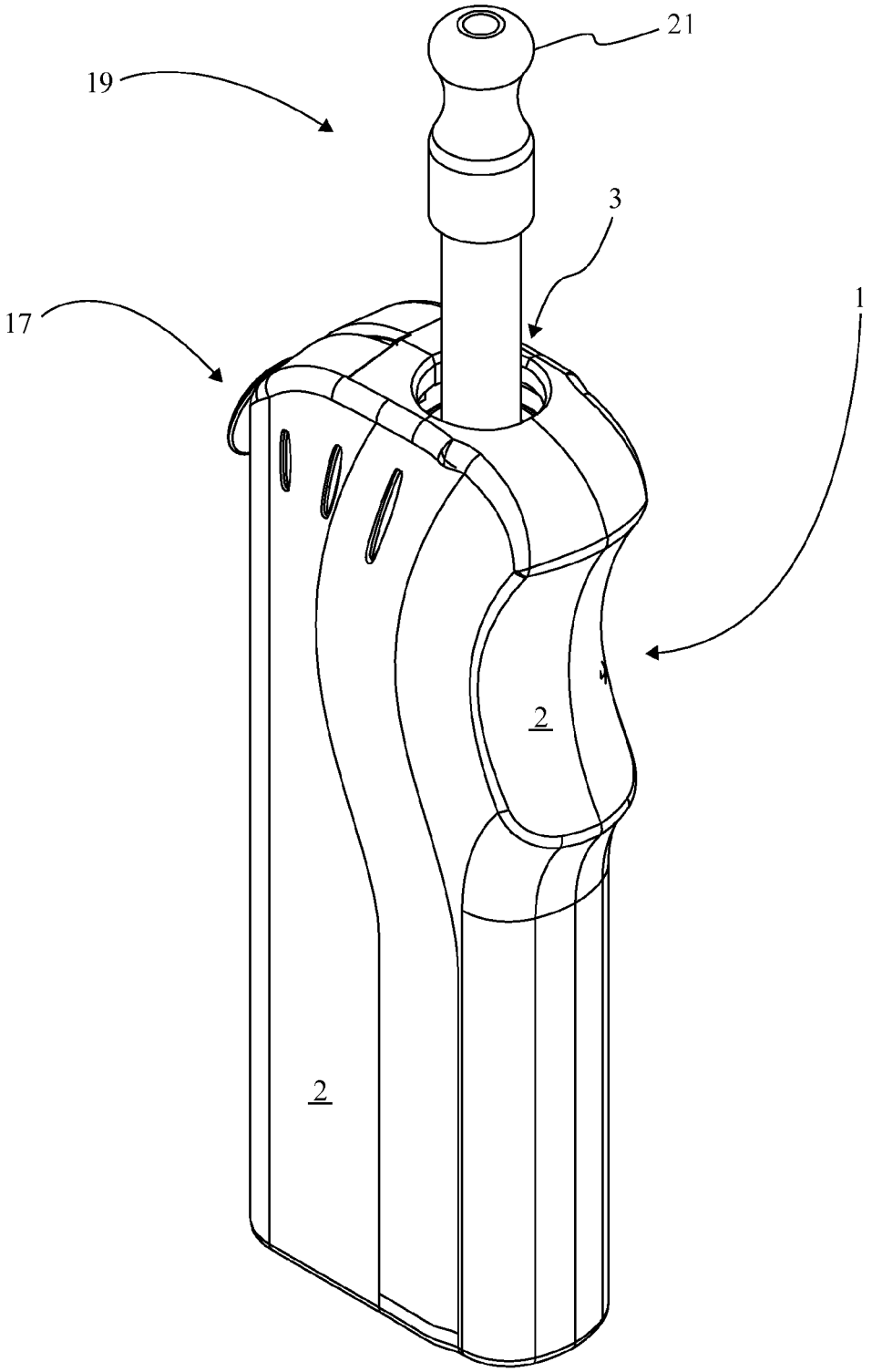
FIG. 2 is a top perspective view displaying the combination electric lighter and portable vaporization device configured with the vaporization device installed as per the current embodiment of the present invention.

All illustrations of the drawings are for the purpose of describing selected versions of the present invention and are not intended to limit the scope of the present invention.

Referencing FIG. 1-4, the present invention is a combination lighter and portable vaporization device 19. The present invention comprises a housing 1, a heating element 8, an electrical source 7, an electrical control module 13, an activator switch 17, and a vaporization device 19. The housing 1 is a shaped enclosure that functions as the mounting point for the heating element 8, the electrical source 7, the electrical control module 13, the activator switch 17, and the vaporization device 19. The electrical source 7, the activator switch 17, the electrical control module 13, and the heating element 8 are found secured at least in part within the housing 1, wherein the activator switch 17 and the electrical control module 13 partially traverse the housing 1. The heating element 8 is an electrically powered component that generates heat. The heating element 8 is found electrically coupled to the electrical source 7 by way of the electrical control module 13. The electrical control module 13 is an electronic component that regulates the charging of the electrical source 7 and the discharging of the electrical source 7 during use. The electrical source 7 is a rechargeable battery that provides the present invention with a portable power source to function as a lighter and portable vaporization device 19. The activator switch 17 is a human engageable means of activating the heating element 8. The activator switch 17 retractably engages the electrical control module 13 in order to activate the heating element 8. The vaporization device 19 is a reusable component that engages the heating element 8 but can be stored within the housing 1 when not in use. The vaporization device 19 is found removeably enclosed within the housing 1.

Referencing FIG. 7-10, the housing 1 is provided as the most visible portion of the present invention. The housing 1 functions as an enclosure that is manipulated by a user. The housing 1 additionally functions as a structural component that provides a secure mounting point for the heating element 8, the electrical source 7, the electrical control module 13, and the activator switch 17. The housing 1 additionally functions as a temporary enclosure for the vaporization device 19 when not in use. In the current embodiment of the present invention, the housing 1 comprises a heating element port 3 and a device chamber 4. The heating element port 3 is provided as an opening in the housing 1 that aligns with the heating chamber 9 of the heating element 8. The device chamber 4 is provided as an embedded storage location within the housing 1 for the vaporization device 19. The housing 1 additionally comprises a formed exterior 2. The formed exterior 2 provides a plurality of contours to the housing 1 provide an ergonomic profile allowing for facilitated manipulation by the user. The housing 1 is provided with a plurality of component mounts that distribute and securely engage the electrical control module 13, the electrical source 7, the heating element 8, and the activator switch 17 within the housing 1. The plurality of component mounts provide the electrical control module 13, the electrical source 7, the heating element 8, and the activator switch 17 manner with an arrangement that is optimally suited for their individual function and interaction.

Figure 3:
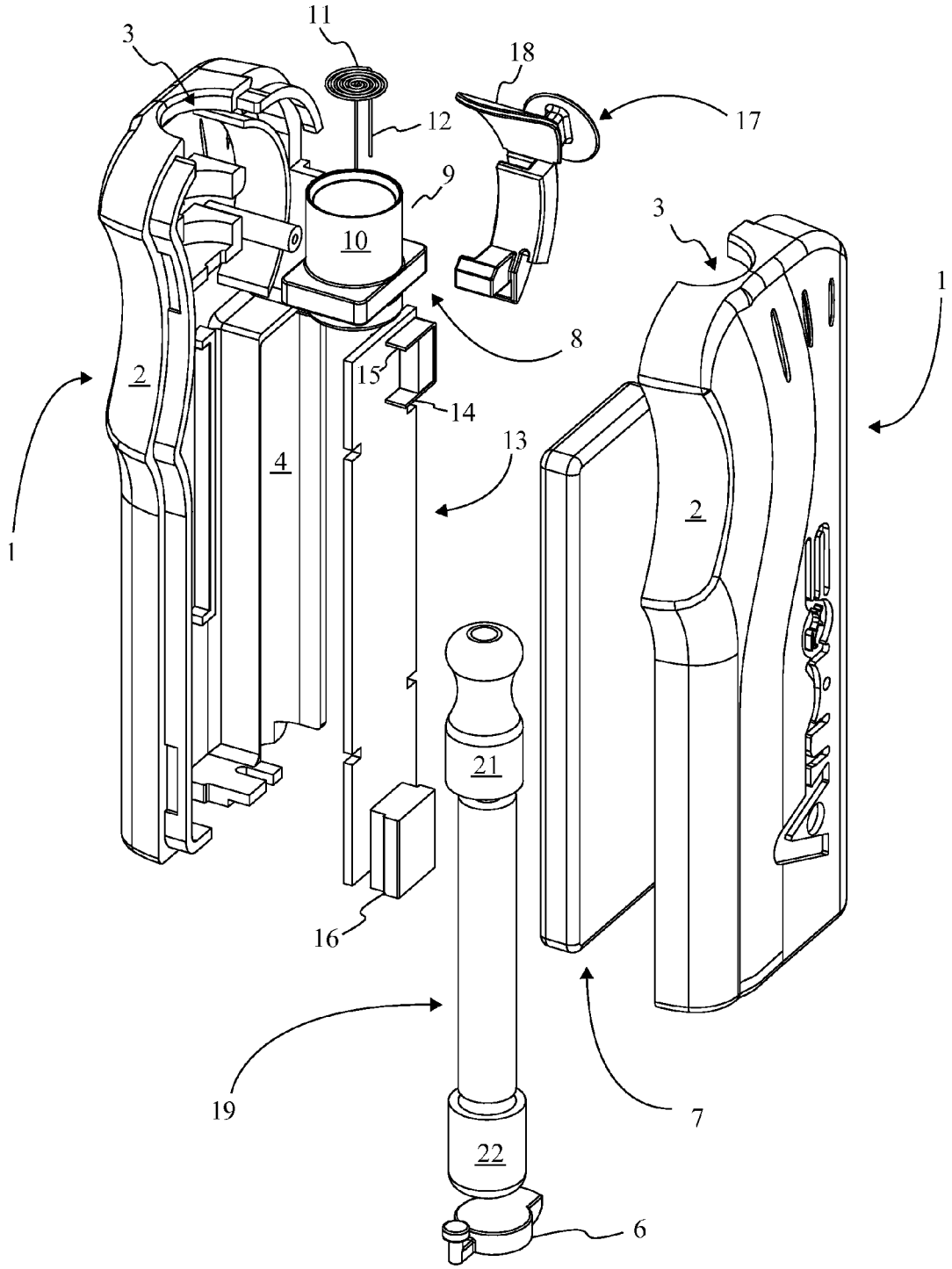
FIG. 3 is an expanded perspective view displaying the combination electric lighter and portable vaporization device as per the current embodiment of the present invention.
Figure 4:
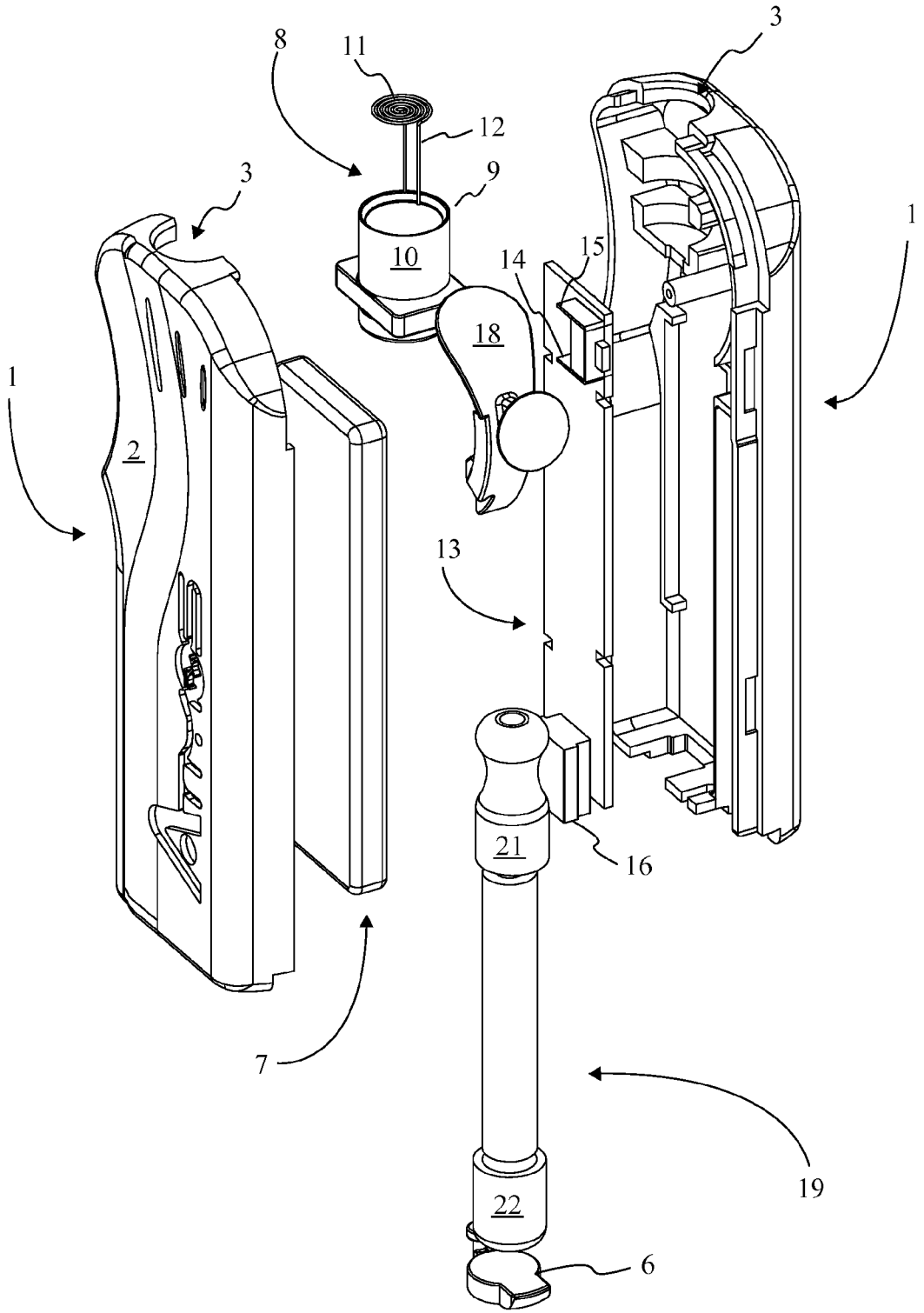
FIG. 4 is another expanded perspective view displaying the combination electric lighter and portable vaporization device as per the current embodiment of the present invention.
Figure 5:
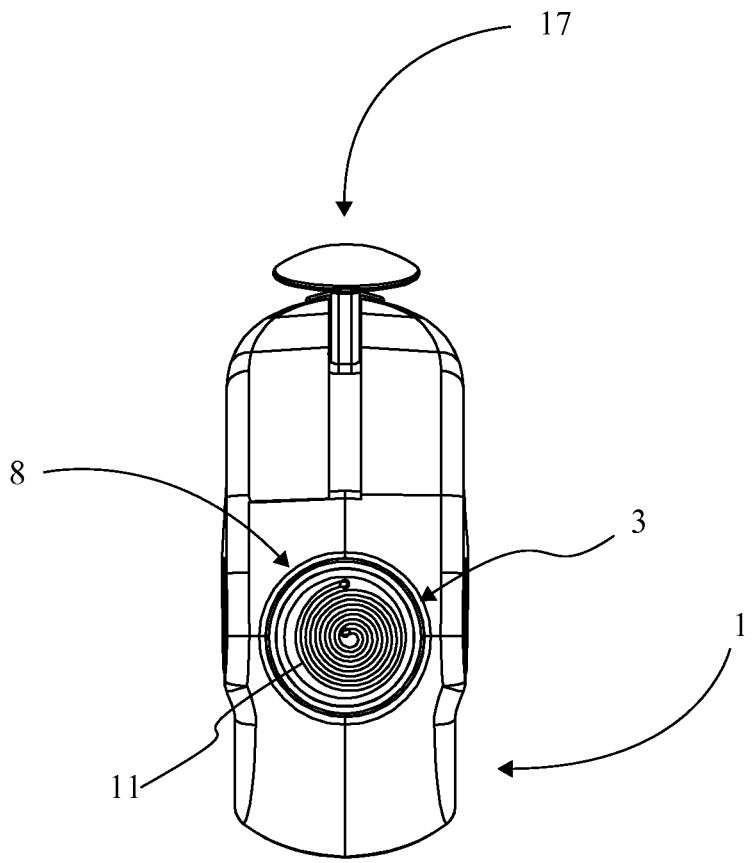
FIG. 5 is a top elevational view displaying the combination electric lighter and portable vaporization device as per the current embodiment of the present invention.
Figure 6:
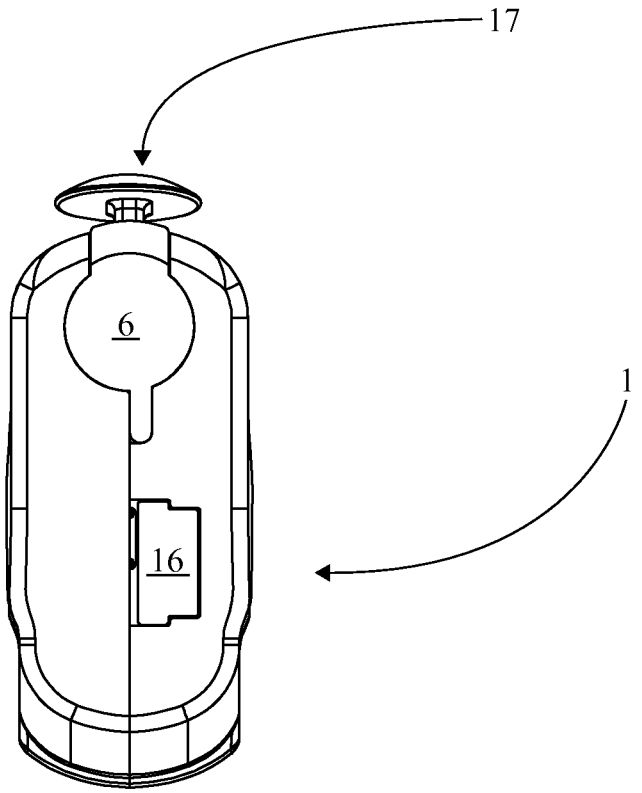
FIG. 6 is a bottom elevational view displaying the combination electric lighter and portable vaporization device as per the current embodiment of the present invention.
Figure 7:
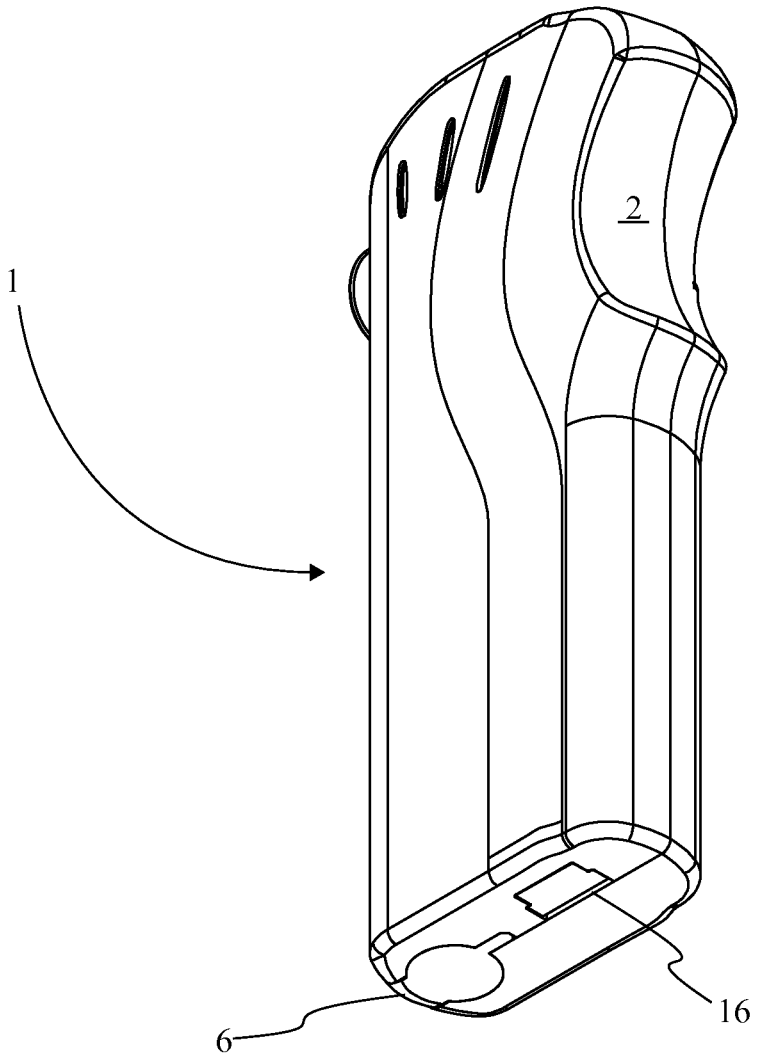
FIG. 7 is a lower perspective view displaying the combination electric lighter and portable vaporization device configured with the vaporization device installed as per the current embodiment of the present invention.

Referencing FIG. 3-5, the heating element 8 is found embedded within the housing 1. The heating element port 3 traverses into the housing 1. The plurality of component mounts provides the heating element 8 with an engagement that allows the heating chamber 9 to be centrally aligned with the heating element port 3. Positioned adjacent to the heating element 8 is the activator switch 17. The activator switch 17 is also secured to the housing 1 through the plurality of component mounts. The activator switch 17 is provided with a moveable engagement in order to function as a switch with the electrical control module 13. The adjacent positioning and the moveable engagement of the activator switch 17 allows the heating chamber cover 18 to intersect between the heating chamber 9 and the heating element port 3 when the activator switch 17 is disengaged from the electrical control module 13. The heating chamber cover 18 is retractably positioned between the heating element port 3 and the heating chamber. The retractable positioning of the heating chamber cover 18 protects the heating coil 11 and the heating chamber 9 when the present invention is deactivated.

Figure 8:
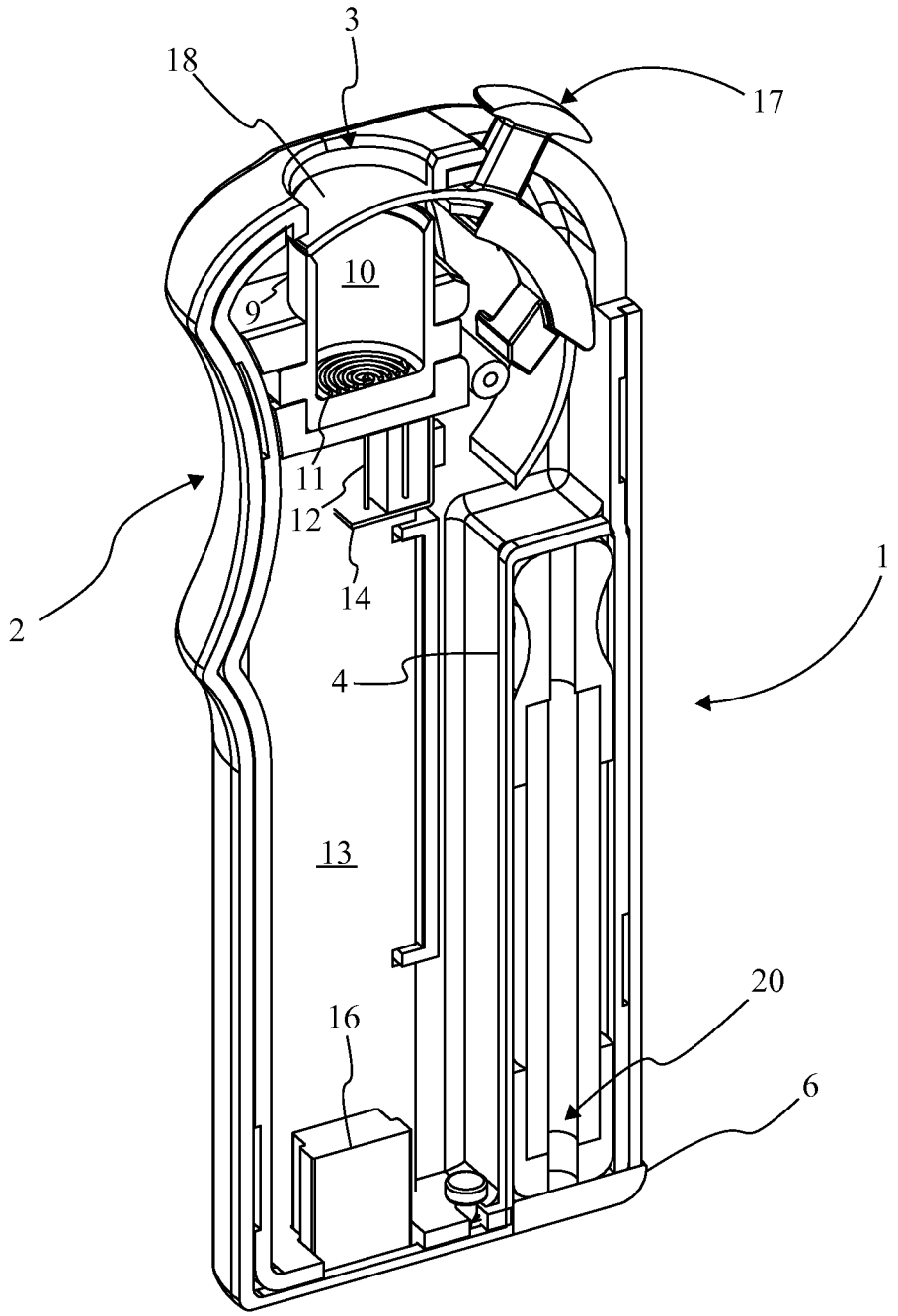
FIG. 8 is a cross sectional view displaying the combination electric lighter and portable vaporization device configured in the deactivated state with the heating element cover positioned on top of the heating chamber.
Figure 9:
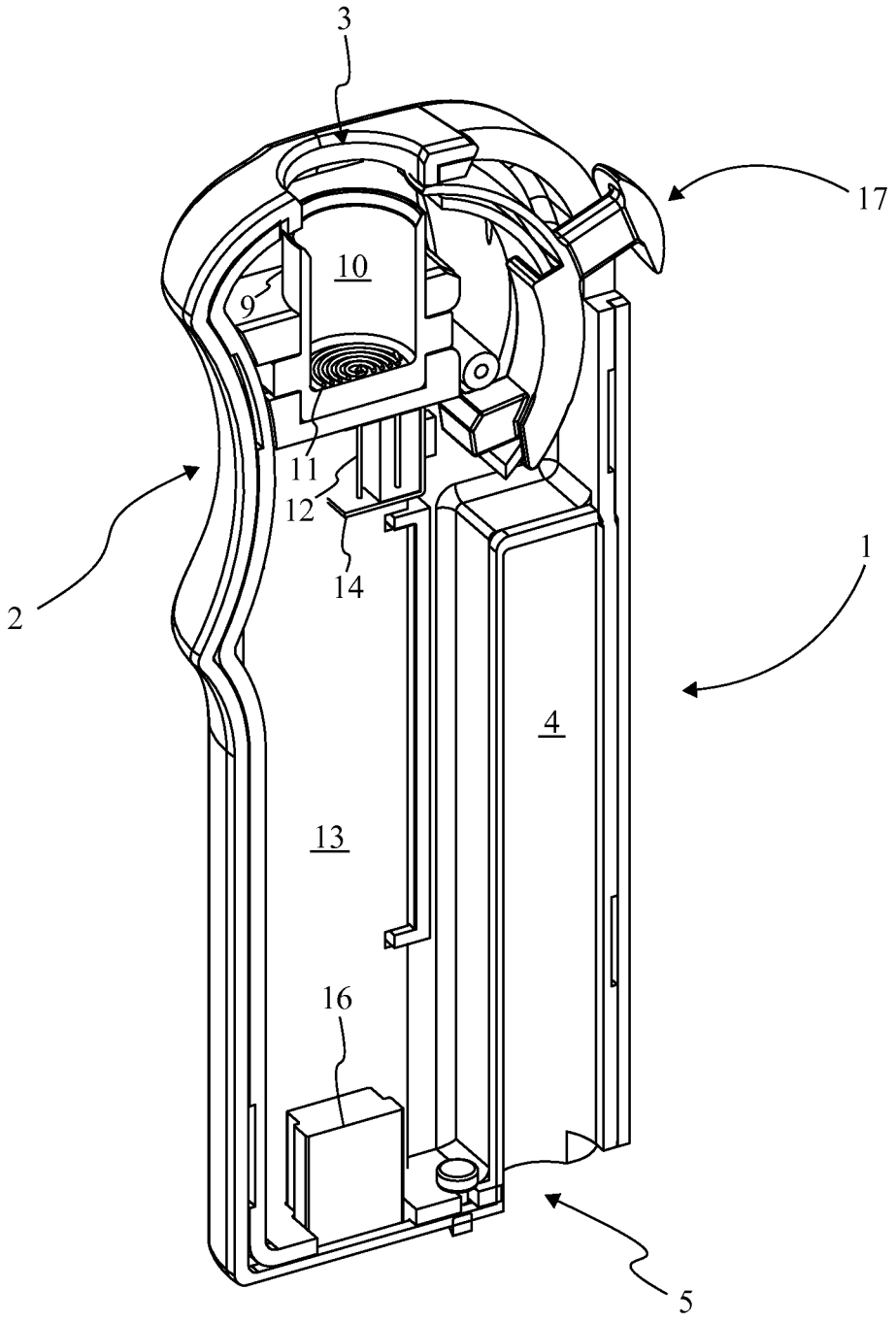
FIG. 9 is a cross sectional view displaying the combination electric lighter and portable vaporization device configured in the activated state with the heating element cover in the retracted positioned and with the vaporization device removed from the device chamber.
Figure 10:
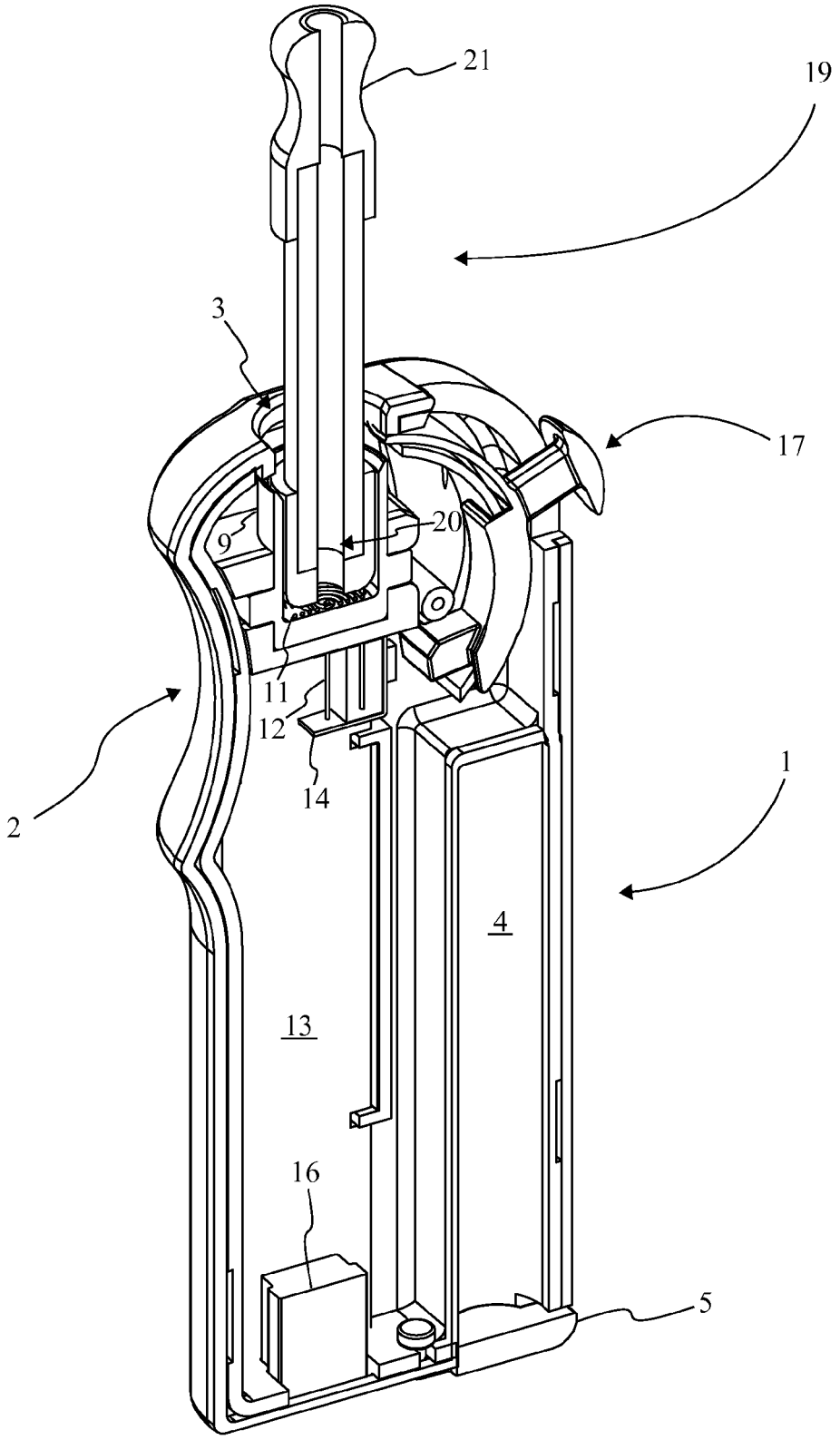
FIG. 10 is a cross sectional view displaying the combination electric lighter and portable vaporization device configured in the activated state with the vaporization device detachably engaged to the heating element.

Referencing FIG. 8-10, the device chamber 4 is embedded at least in part within the housing 1, wherein components of the device chamber 4 may in fact be positioned outside of the housing 1 in order to facilitate their functionality. The device chamber 4 is provided as the specialized storage compartment for the vaporization device 19. The device chamber 4 provides a facilitated means of storing the vaporization device 19 when not in use. The device chamber 4 comprises a port opening 5 and a port cover 6. The port opening 5 is provided as an access means for the interior area of the device chamber 4. In order to store the vaporization device 19 within the device chamber 4, the vaporization device 19 must traverse the device opening. The port cover 6 is an attached component that is a removeably engaged to the port opening 5. The port cover 6 encloses the device chamber 4 and retains the vaporization device 19 within the device chamber 4. The port cover 6 is able to lift and rotate out of the engagement with the port opening 5 but can additionally be provided with an means that facilitates the enclosure of the device chamber 4.

Referencing FIG. 3-5, the heating element 8 is provided as the heat source capable of functioning as the ignition device for a plurality of smoking products as well the specialized heat source for the vaporization device 19. The heating element 8 comprises a heating chamber 9 and a heating coil 11. The heating chamber 9 is provided as a heat resistant element that houses the heating coil 11. The heating chamber 9 is mounted to the housing 1 with the interior portion of the heating chamber 9 centrally aligned with the heating element port 3. The heating chamber 9 is appropriately sized for fitment with a plurality of smoking products. The heating coil 11 is centrally positioned within the heating chamber 9, opposite the positioning of the heating element port 3. The heating coil 11 is positioned concentrically to the lateral wall 10 of the heating chamber 9. The heating coil 11 traverse through the heating chamber 9 by way of at least one terminal 12. The electrical control module 13 is found electrically coupled to the heating coil 11 by way of the at least one terminal 12. The at least one terminal 12 is utilized as the engagement means between the electrical control module 13 and the heating coil 11. The electrical control module 13 provides the heating coil 11 with sufficient current to maintain a nominal heat appropriate for igniting the plurality of smoking products. Additionally, the nominal heat created by the heating coil 11 would be appropriate for vaporizing a plurality of vaporizable materials utilized by the vaporization device 19. It should be noted that the heating coil 11 is configured to reach optimal operating temperature within a short period of time through the use of thermally conductive material with a large electrical resistance coefficient.

Referencing FIGS. 3-6 and FIGS. 8-10, the electrical control module 13 is the electrical component responsible for regulating battery functionality as well as distributing current to the heating element 8. The electrical control module 13 comprises a battery coupler 14, a heating element connector 15, and a charging port 16. The battery coupler 14 is the means by which the electrical source 7 is engaged to the electrical control module 13. The battery coupler 14 provides the dual directional current flow between the electrical control module 13 and the electrical source 7. Current flows towards the electrical source 7 from the electrical control module 13 during a charging cycle, wherein the charging cycle is understood as the instances when the current is flowing from the charging port 16 and through the electrical control module 13 towards the electrical source 7. Current flows from the electrical source 7 to the electrical control module 13 during a discharging cycle, wherein the discharging cycle is understood as the instances when current from the electrical source 7 flows through the electrical control module 13 and towards the heating element 8. The charging port 16 provides the electrical control module 13 with a means to recharge the electrical source 7, the charging port 16 may be provided as proprietary connection or could utilizes a non-proprietary connection method such as USB mini. The charging port 16 is found traversing the housing 1 adjacent to the port opening 5. Both the charging port 16 and the port opening 5 are found positioned opposite the orientation of the heating element port 3. The positioning of the charging port 16 adjacent to the port opening 5 facilitate the operation of the present invention while charging, wherein charging is understood as having a charging cable plugged into the charging port 16 while the heating element 8 is activated. The heating element connector 15 is an electrical coupling that permits current to flow between the electrical control module 13 and the heating element 8. The heating element 8, specifically the heating coil 11, requires an electrical current in order to function properly. The heating coil 11 contains the at least one terminal 12 that functions as an electrical lead that engages the heating element connector 15. Through the engagement between the heating element connector 15 and the electrical lead, the electrical control module 13 is able to provide sufficient current in order to operate the heating coil 11.

Referencing FIG. 8-10, the activator switch 17 is the user controlled element that initiates the distribution of current from the electrical source 7 to the heating element 8. The activator switch 17 comprises a heating chamber cover 18. the activator switch 17 could function in an "as needed" capacity, wherein the user would hold the activator switch 17 for the duration of use, but can additionally be provided in an automated or "one touch" capacity, wherein the initial interaction with the activator switch 17 would automatically being signal the electrical control module 13 to begin supplying the heating element 8 with sufficient charge for a specified duration.

Referencing FIG. 3 and FIG. 4, the electrical source 7 is provided as a rechargeable battery. The rechargeable battery is mounted within the housing 1. The electrical source 7 is secured to the inner portion of the housing through a plurality of internal component mounts. The electrical source 7 is electrically engaged to the electrical control module 13 by way of the battery coupler 14. It should be noted that rechargeable battery is herein after referred to as the battery unless otherwise noted. While the attachment method for the battery does not explicitly describe the battery as being removable, it should be noted that the current embodiment of the present invention provides the battery as a non-detachable component. Although the current embodiment provides the battery as a non-detachable component, additional embodiment can provide a removable battery or a battery compartment latch. The battery is found coupled to the electrical control module 13. The attachment between the electrical control module 13 and the battery, allows for the battery to be recharged. This is accomplished by the electrical control module 13 regulating the amperage needed to charge the battery. In the preferred embodiment of the present invention the battery utilized as the electrical source 7 consists of a lithium ion battery. It should be noted that any battery type could potentially be utilized as long as it allows the present invention to function in its current capacity.

Referencing FIG. 2 and FIG. 8-10, the vaporization device 19 is provided as a reusable attachment that is stored within the device chamber 4 of the housing 1. The vaporization device 19 is a personal smoking device that detachably couples to the heating element 8. The vaporization device 19 utilizes the heating element 8 as a heat source in order to vaporize various compounds found within the vaporization device 19. The vaporization device 19 comprises an inner chamber 20, device mount 22, and a mouth piece 21. The device mount 22 is the lower portion of the vaporization device 19 that retains the vaporizable material. The device mount 22 is provided with the means to detachably engage the lateral wall 10 of the heating chamber 9. The device mount 22 is found positioned opposite the mouth piece 21 along the length of the vaporization device 19. The device mount 22 aligns the inner chamber 20 with the heating coil 11 so that the inner chamber 20 is positioned normal to the heating coil 11. The normal positioning has been determined as being the optimally suited alignment for heating the vaporizable material. The device mount 22 forms a hermetic seal with the heating chamber 9 in order to limit air flow to the vaporizable material. The vaporization device 19 is provided with a particular arrangement that positions the device mount 22, the inner chamber 20, and the mouth piece 21 in a collinear alignment. The collinear alignment permits the vaporized gases formed when heating the vaporizable material to travel through the inner chamber 20 and towards the mouth piece 21. The mouth piece 21 contains a vapor channel that centrally traverses through the mouth piece 21 into the inner chamber 20. The alignment between the vapor channel and the inner chamber 20 provides a means of exhausting the vaporized material. Since the mouth piece 21 is the portion of the device that is placed near a user's mouth during inhalation, the mouth piece 21 is constructed of a material that is insulated heat diffusing material. The user would use the mouth piece 21 to inhale vaporized material formed within the inner chamber 20 of the vaporization device 19. When the vaporization device 19 is no longer in use, the user can store the vaporization device 19 within the device chamber 4. The user would remove the port cover 6 from its positioning with the port opening 5. The user would then align the vaporization device 19 with the device chamber 4. The vaporization device 19 would traverse through the port opening 5 and into device chamber 4. The user would then realign the port cover 6 onto the port opening 5, securely retaining the vaporization device 19 within the device chamber 4. While the attachment means between the mount and the chamber are not explicitly described, it should be noted that a permanent attachment as well as a detachable coupling could potentially be utilized as long as the access to the internal compartment of the mount are permitted and that the attachment means provides an air tight seal that is not affected by heat.

In the current embodiment of the present invention, the heating chamber 9 is constructed of an insulated material that prevents heat transfer from the heating coil 11 to damage the housing 1. The insulated material additionally provides improved directionally for the heat generated by the heating coil 11.

In the current embodiment of the present invention, the electrical control module 13 manages the current from the electrical source 7 during the charging cycle and the discharging cycle. The electrical control module 13 provides the electrical source 7 with a means of distributing the current from the electrical source 7 to a plurality of electrical components. The electrical control module 13 permits for additional features such as a temperature control element to be introduced into the functionality of the heating element 8. A user could utilize the temperature control element to adjust the specific operating temperature of the heating coil 11 in order to optimally ignite or vaporize a particular smoking product. The electrical control module 13 is primarily provided to manage the electrical functions of the present invention, it should be noted that its components share commonality with other electrical devices. These electrical devices include a plurality of consumer electronics and computerized devices. It should be noted that integration with additional consumer electronics would provide the present invention with additional functionality and could potentially allows for multiple device interactivity if so desired.

The plurality of smoking products that can be ignited by the present invention include but are not limited to cigarettes and cigars. The portable vaporization device 19 can vaporize a plurality of vaporizable products that include but are not limited to herbaceous matter such as dried herbs and spices, crystalline extracts or compounds, such as dried flavored nicotine containing compounds as well as any combination thereof.

In an additional embodiment of the present invention, the housing 1 may incorporate slotted vents. The slotted vents would be positioned near the heating element 8 and could function as a means of dissipating heat generated by the heating coil 10. The slotted vents could additionally function as a means of increasing air flow to the heating chamber 9. The increased air flow would allow the plurality of smoking products to ignite within the heating chamber 9.

Although the invention has been explained in relation to its preferred embodiment, it is to be understood that many other possible modifications and variations can be made without departing from the spirit and scope of the invention as hereinafter claimed.

What is claimed is:

1. A combination electric lighter and portable vaporization device comprises: a housing;
- a heating element;
- an electrical source, wherein the electrical source is a rechargeable battery;
- an electrical control module;
- an activator switch;
- a vaporization device;
- the housing comprises a heating element port and a device chamber;
- the heating element comprises a heating chamber and a heating coil;
- the electrical control module comprises a battery coupler, a heating element connector, and a charging port;
- the vaporization device comprises an inner chamber, a mouth piece, and device mount;
- the device chamber comprises a port opening and a port cover;
- the heating chamber comprises a lateral wall;
- the heating coil comprises at least one terminal;
- the activator switch comprises a heating chamber cover;
- the heating element being electrically coupled to the electrical source by way of the electrical control module;
- the electrical control module being retractably engaged by the activator switch;
- the electrical source, the activator switch, the electrical control module, and the heating element being secured at least in part within the housing;
- the vaporization device being removeably enclosed within the housing;
- the heating element being embedded within the housing;
- the heating chamber being centrally aligned with the heating element port;
- the activator switch being positioned adjacent to the heating element port;
- the heating chamber cover being retractably positioned between the heating chamber and the heating element port; and
- the heating coil being positioned within the heating chamber opposite the heating element port.

2. The combination electric lighter and portable vaporization device in claim 1 wherein the housing comprises a formed exterior.

3. The combination electrical lighter and portable vaporization device as claimed in claim 1 comprises:
- the heating coil being concentrically positioned to the lateral wall; and
- the heating coil centrally traverses the heating chamber by way of the at least one terminal.

4. The combination electric lighter and portable vaporization device as claimed in claim 1 comprises:
- the device chamber being embedded at least in part within the housing;
- the vaporization device traverses into the device chamber by way of the port opening;
- the port cover being removably engaged to the port opening; and
- the vaporization device being removeably retained within the device chamber by way of the port cover.

5. The combination electrical lighter and portable vaporization device as claimed in claim 1 comprises:
- the electrical control module being electrically coupled to the electrical source by way of the battery coupler;
- the at least one terminal being electrically coupled to the electrical control module by way of the heating element connector; and
- the charging port traverses through the housing adjacent to the port opening.

6. The combination electrical lighter and portable vaporization device as claimed in claim 1 comprises:
- the inner chamber traverses the device mount and the mouth piece;
- the device mount being detachably engaged to the lateral wall;
- the heating coil being positioned coincident with the device mount opposite the mouth piece; and
- the inner chamber being positioned normal to the heating coil.

7. A combination electric lighter and portable vaporization device comprises: a housing;
- a heating element;
- an electrical source, wherein the electrical source is a rechargeable battery;
- an electrical control module;
- an activator switch;
- a vaporization device;
- the housing comprises a heating element port, a device chamber, and formed exterior;
- the heating element comprises a heating chamber and a heating coil;
- the electrical control module comprises a battery coupler, a heating element connector, and a charging port;
- the vaporization device comprises an inner chamber, a mouth piece, and device mount;
- the device chamber comprises a port opening and a port cover;
- the heating chamber comprises a lateral wall;
- the heating coil comprises at least one terminal;
- the activator switch comprises a heating chamber cover;
- the heating element being electrically coupled to the electrical source by way of the electrical control module;
- the electrical control module being retractably engaged by the activator switch;

the electrical source, the activator switch, the electrical control module, and the heating element being secured at least in part within the housing;

the vaporization device being removeably enclosed within the housing;

the heating element being embedded within the housing;

the heating chamber being centrally aligned with the heating element port;

the activator switch being positioned adjacent to the heating element port;

the heating chamber cover being retractably positioned between the heating chamber and the heating element port; and the heating coil being positioned within the heating chamber opposite the heating element port.

8. The combination electrical lighter and portable vaporization device as claimed in claim 7 comprises:

the heating coil being concentrically positioned to the lateral wall;

the heating coil centrally traverses the heating chamber by way of the at least one terminal;

the inner chamber traverses the device mount and the mouth piece;

the device mount being detachably engaged to the lateral wall;

the heating coil being positioned coincident with the device mount opposite the mouth piece; and the inner chamber being positioned normal to the heating coil.

9. The combination electric lighter and portable vaporization device as claimed in claim 7 comprises:

the device chamber being embedded at least in part within the housing;

the vaporization device traverses into the device chamber by way of the port opening;

the port cover being removably engaged to the port opening;

the vaporization device being removeably retained within the device chamber by way of the port cover;

the electrical control module being electrically coupled to the electrical source by way to the battery coupler;

the at least one terminal being electrically coupled to the electrical control module by way of the heating element connector; and the charging port traverses through the housing adjacent to the port opening.

10. A combination electric lighter and portable vaporization device comprises: a housing;

a heating element;

an electrical source, wherein the electrical source is a rechargeable battery;

an electrical control module;

an activator switch;

a vaporization device;

the housing comprises a heating element port, a device chamber, and formed exterior;

the heating element comprises a heating chamber and a heating coil;

the electrical control module comprises a battery coupler, a heating element connector, and a charging port;

the vaporization device comprises an inner chamber, a mouth piece, and device mount;

the device chamber comprises a port opening and a port cover;

the heating chamber comprises a lateral wall;

the heating coil comprises at least one terminal;

the activator switch comprises a heating chamber cover;

the heating element being electrically coupled to the electrical source by way of the electrical control module;

the electrical control module being retractably engaged by the activator switch;

the electrical source, the activator switch, the electrical control module, and the heating element being secured at least in part within the housing;

the vaporization device being removeably enclosed within the housing;

the heating element being embedded within the housing;

the heating chamber being centrally aligned with the heating element port;

the activator switch being positioned adjacent to the heating element port;

the heating chamber cover being retractably positioned between the heating chamber and the heating element port;

the heating coil being positioned within the heating chamber opposite the heating element port;

the heating coil being concentrically positioned to the lateral wall;

the heating coil centrally traverses the heating chamber by way of the at least one terminal;

the device chamber being embedded at least in part within the housing;

the vaporization device traverses into the device chamber by way of the port opening;

the port cover being removably engaged to the port opening;

the vaporization device being removeably retained within the device chamber by way of the port cover;

the electrical control module being electrically coupled to the electrical source by way of the battery coupler;

the at least one terminal being electrically coupled to the electrical control module by way of the heating element connector;

the charging port traverses through the housing adjacent to the port opening; the inner chamber traverses the device mount and the mouth piece;

the device mount being detachably engaged to the lateral wall;

the heating coil being positioned coincident with the device mount opposite the mouth piece; and the inner chamber being positioned normal to the heating coil.

* * * * *